United States Patent [19]

Hampton

[11] 4,130,957

[45] Dec. 26, 1978

[54] THEFT-PROOF SIGN

[76] Inventor: Marshall D. Hampton, 2125 S. Ammons, Lakewood, Colo. 80227

[21] Appl. No.: 822,132

[22] Filed: Aug. 5, 1977

[51] Int. Cl.[2] ..... G09F 15/00

[52] U.S. Cl. ..... 40/607

[58] Field of Search ..... 40/125 H, 606, 607, 40/10 C; 52/38, 157

[56] References Cited

U.S. PATENT DOCUMENTS

| | | | |
|---|---|---|---|
| 808,764 | 1/1906 | Larsh | 40/607 |
| 832,565 | 10/1906 | Wilson | 52/157 |
| 2,584,713 | 2/1952 | Kanaval | 40/606 |
| 2,872,750 | 2/1959 | Holcomb | 40/606 |

FOREIGN PATENT DOCUMENTS

| | | | |
|---|---|---|---|
| 15278 of | 1912 | United Kingdom | 40/607 |

*Primary Examiner*—Louis G. Mancene
*Assistant Examiner*—Wenceslao J. Contreras
*Attorney, Agent, or Firm*—Edwin L. Spangler, Jr.

[57] ABSTRACT

This invention relates to a theft-proof sign of the type which is stuck into the ground and in which one post is formed to provide a corkscrew that is screwed into the ground while the other is eliminated altogether and replaced by a corkscrew stake chain locked or otherwise detachably fastened thereto.

5 Claims, 4 Drawing Figures

THEFT-PROOF SIGN

Certain businesses, particularly real estate brokers, need temporary signs to advise potential customers that a particular property is for sale. Large tracts of undeveloped land oftentimes warrant the expense of a permanent sign; however, this is seldom true of residential property. The net result is that most real estate brokers, rental agents and the like use temporary metal signs that they can merely stick into the ground and leave on display until such time as the property is sold, they lose their listing or the property is taken off the market.

While such signs are temporary in the sense that they remain in a given location only a limited period of time, they are by no means inexpensive, even small ones costing $25.00 or so depending upon how fancy they are. A particular broker will own anywhere from a few of these signs to several hundred depending upon the size of the organization, the number of properties it has listed, the geographical areas in which its salespeople work, etc. Regardless of the size of the organization, theft becomes a very real problem both because of the cost of replacing the sign itself and also because of the time and effort it takes to set one up again. In the meantime, of course, the brokers advertising message is not to be seen but, most important, the homeowner's property is, to some extent at least, off the market.

These signs come in two general types, the single post version and the double post one. In either event, the single post or both are merely stuck or hammered into the ground on the lawn in front of the listed property. Vandals and pranksters find that it takes but a few seconds to remove one and haul it away in a waiting vehicle only to have it adorn some teenagers bedroom wall or, just as often, appear on the girlfriends's lawn along with a dozen others.

The problem could be largely eliminated if one could come up with a simple way of anchoring such signs in the ground because, after all, they are not worth a major effort at removing them and the prankster who is probably primarily responsible for stealing most of these that are taken is probably rather easily discouraged. If it were possible, therefore, to make an inexpensive yet easily anchored sign, there should be an excellent market for them among real estate brokers and others having problems with the theft of their temporary signs. The present invention constitutes just such a sign and, for all practical purposes, it solves the theft problem by the simple, yet unobvious, expedient of eliminating the spike-like posts of both the single and double post versions and replacing them with a single permanent corkcrew leg that screws into the ground as the sign itself is turned. Then, once the sign has been screwed in place, it is secured against further rotation by a corkscrew stake screwed into the ground in spaced relation to the post and then chain locked to the sign itself. The resulting assembly cannot, for all practical purposes, be removed without cutting off the post or stake with a hacksaw or cutting the chain with a bolt cutter, all of which takes a fair amount of time and requires the use of some type of tool. Secure as it is, the sign can be placed and removed almost as fast as the conventional spike-legged ones. Moreover, its cost is minimally more expensive especially when one considers the fact that it pays for itself very shortly in reduced replacement costs.

It is, therefore, the principal object of the present invention to provide a novel and improved theft-proof sign.

A second objective is to provide a device of the type aforementioned which is simple to both install and remove by hand yet requires the use of tools to steal it once chain locked in place.

Another object is to provide a temporary metal sign that can vary widely in style and size yet be rendered theft-proof in accordance with the teaching found herein.

Still another objective is to provide a sign with a single permanent corkscrew post that cooperates with a screw-in stake and chain lock to secure same against unauthorized removal.

An additional object is to provide a theft-proof sign of the type forming the subject matter hereof wherein the advertiser's message is not interferred with nor is the assembly rendered unattractive by the means used to anchor same in the ground.

Further objects are to provide a ground-anchored sign which is rugged yet lightweight, relatively inexpensive, versatile, safe, and even decorative.

Other objects will be in part apparent and in part pointed out specifically hereinafter in connection with the description of the drawings that follows, and in which.

Figure 1:
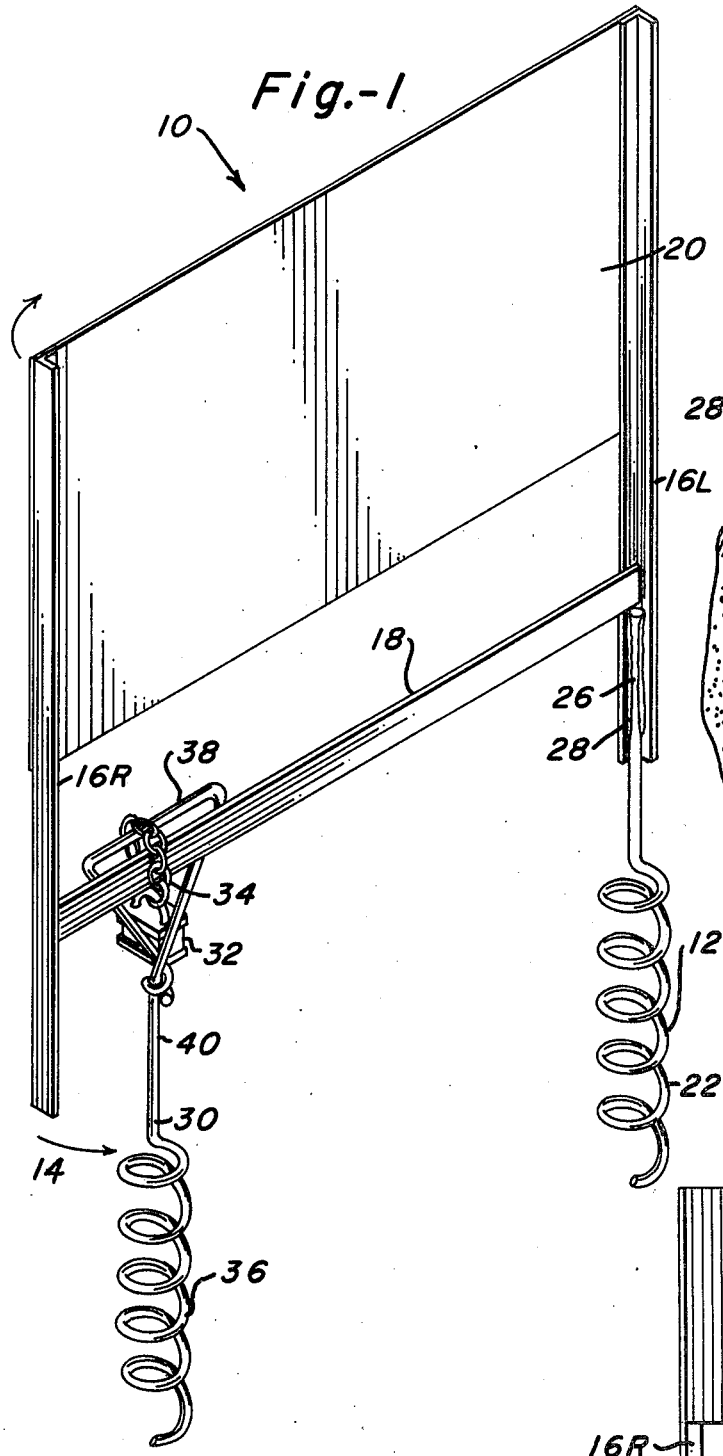
FIG. 1 is a perspective view looking at the rear of the theft-proof sign.

Referring next to the drawings for a detailed description of the present invention, reference numeral 10 has been chosen to broadly designate the sign including its permanent corkscrew post 12 while numeral 14 has been selected to similarly designate the tie-down or anchoring subassembly. The sign 10, in the particular form shown, has a pair of upright sideframe elements 16L and 16R arranged in transversely-spaced parallel relation and interconnected adjacent their lower ends by a horizontally-disposed crossbar 18. Bolted or otherwise attached to these sideframe members is a rectangular metal plate 20 upon which is displayed the user's name and advertising message.

Figure 2:
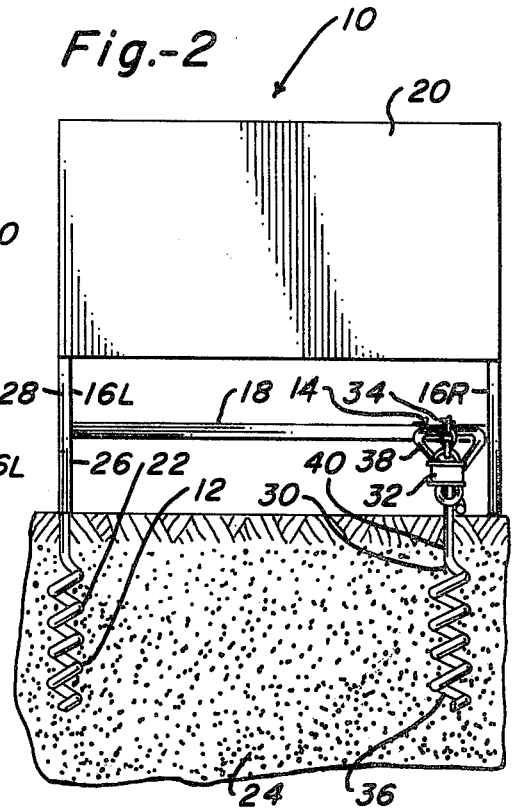
FIG. 2 is a front elevation to a reduced scale.
Figure 3:
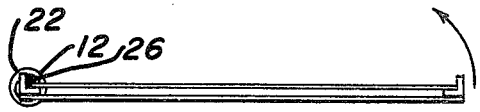
FIG. 3 is a top plan view of the sign alone to the same scale as FIG. 2.
Figure 4:
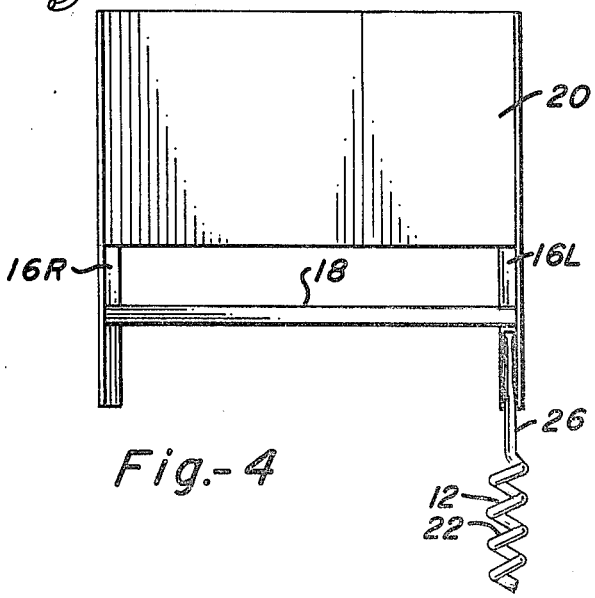
FIG. 4 is a rear elevation of the sign alone to the same scale as FIGS. 2 and 3.

Forming an extension of one of the sideframe members (16L as shown) is a large diameter metal rod shaped to define permanent corkscrew post 12. This post includes a loose-wound helical section 22 on its lower end adapted to be screwed into the ground 24 as shown in FIG. 2 and a straight section 26 on the upper end capable of being permanently attached to the upright 16 such as by means of weld 28. While post 12 can be welded to this sideframe member 16 anywhere and still function as an extension thereof in accordance with the teaching found herein, the preferred manner of attachment is inside the corner of the angle irons out of which such sideframe elements are customarily fabricated.

The tie-down or anchoring subassembly 14 comprises an independent corkscrew stake 30, a padlock 32 and a short length of chain 34. The stake 30 also includes a loose-wound helical section 36 at its lower end as did post 12; however, instead of being permanently attached to the frame, it preferably terminates at its upper extremity in a combination handle and eye 38 in the manner of the well-known stakes used to tie down pets out of doors. If desired, a short straight section 40 can be used between the corkscrew and handle to prevent having to run the helical convolutions all the way up. The handle, of course, facilitates screwing the stake into the ground in the well-known manner of such items. The eye formed therein, however, answers the additional need of a means through which the chain 34 can be reaved as shown.

In use, the permanent corkscrew post 12 of the sign is screwed well down into the ground as shown in FIG. 2. Stake 30 is similarly screwed into the ground in approximately the position that the missing leg of the sign would normally occupy. This can be done either after the sign is screwed into the ground by merely swinging it to or fro out of the way or, alternatively, the stake can be placed in the ground first and the sign located relative thereto. Either way, the sign 12 and the stake 30 end up in approximately the relationship shown in FIGS. 1 and 2; whereupon, the chain 34 is looped over the crossbar 18 and through eye 38 preparatory to being detachably locked in place with padlock 32.

While it has not been illustrated, those temporary signs having but one upright defining a centerpost can readily be adapted by a person of ordinary skill to make use of the instant invention by merely fitting such centerpost with the corkscrew extension 22 and providing the sign itself or such other lateral extension as might be available and which rotates with the post with some suitable means for padlocking the stake 14 thereto using anchor chain 34 at a point spaced to one side of the modified centerpost so that neither it nor the stake can be turned enough to remove them from the ground.

What is claimed is:

1. The theft-proof sign which comprises: a metal frame having a single corkscrew-shaped post for screwing same into the ground, laterally-extending means secured to said frame for rotation therewith extending beyond said post on at least one side thereof, a corkscrew-shaped stake adapted to be screwed into the ground in spaced relation alongside said post, and anchoring means detachably interconnecting said stake and frame effective to prevent sufficient rotation of either said stake or post to effect removal thereof from the ground.

2. The theft-proof sign as set forth in claim 1 wherein the laterally-extending means comprises a crossbar.

3. The theft-proof sign as set forth in claim 1 wherein the stake includes a handle-forming eye at its upper end, and said anchoring means includes a chain reavable through said eye and around said laterally-extending means.

4. The theft-proof sign as set forth in claim 1 wherein the anchoring means comprises a chain or cable and padlock subassembly.

5. The theft-proof sign as set forth in claim 1 wherein the post is disposed at one side of the frame and the laterally-extending means comprises a crossbar projecting to one side thereof.

* * * * *